United States Patent [19]

Kemmerer et al.

[11] Patent Number: 4,712,475

[45] Date of Patent: Dec. 15, 1987

[54] INKING ROLLER FOR PRINTING MACHINES

[75] Inventors: Klemens Kemmerer, Seligenstadt; Peter Hummel, Offenbach am Main, both of Fed. Rep. of Germany

[73] Assignee: M.A.N.-Roland Druckmaschinen Aktiengesellschaft, Fed. Rep. of Germany

[21] Appl. No.: 873,815

[22] Filed: Jun. 13, 1986

[30] Foreign Application Priority Data

Jun. 14, 1985 [DE] Fed. Rep. of Germany ..... 3521424

[51] Int. Cl.[4] ..... B41F 31/26

[52] U.S. Cl. ..... 101/348; 34/124

[58] Field of Search ..... 101/348, 349, 350, 148, 101/375, 376; 34/119, 124, 125, 134; 165/89, 90; 29/123, 124

[56] References Cited

U.S. PATENT DOCUMENTS

| | | | |
|---|---|---|---|
| Re. 30,302 | 6/1980 | Stanislaw | 165/89 |
| 3,224,110 | 12/1965 | Kroon | 34/124 |
| 3,228,462 | 1/1966 | Smith, Jr. | 34/119 X |
| 4,050,510 | 9/1977 | Theysohn | 34/124 X |
| 4,183,298 | 1/1980 | Cappel et al. | 34/124 X |
| 4,534,289 | 8/1985 | Durrnagel et al. | 101/348 |

FOREIGN PATENT DOCUMENTS

| | | | |
|---|---|---|---|
| 954331 | 12/1949 | France | 34/124 |
| 839058 | 6/1960 | United Kingdom | 34/124 |

*Primary Examiner*—J. Reed Fisher

*Attorney, Agent, or Firm*—Leydig, Voit & Mayer

[57] ABSTRACT

An inking roller for an offset printing machine, through the interior of which a temperature-control medium flows. The roller is formed of aluminum in a barrel shape with journals mounted at both ends. The cross-sections of the plurality of ducts formed in the wall of the barrel result in an optimally uniform surface temperature for the inking roller. On one side of the inking roller the ducts have openings so that the flow and return alternate inside the barrel. The opposite ends of the ducts communicate with openings which establish the counter flow of fluid through the barrel.

5 Claims, 4 Drawing Figures

INKING ROLLER FOR PRINTING MACHINES

FIELD OF THE INVENTION

The present invention relates generally to an inking roller for offset printing machines, and more particularly concerns such a roller having internal passages through which a temperature-control medium flows and which is adapted to be supplied and discharged at one end of the roller.

BACKGROUND OF THE INVENTION

The temperature control of inking rollers in printing machine inking units has in the past been achieved in various forms. German Pat. No. 2,658,380, for example, discloses a temperature-controlled inking roller in which at least one displacement member is disposed inside the inking roller. The unoccupied cross-section of the inking roller is divided up into two concentric annular gaps by a partition in the form of a casing having good thermal conductivity. The annular gaps have a temperature-control medium flowing therethrough at high speed in counter-current fashion. The problem with this arrangement is to devise an inking roller so that the ink temperatures remain largely constant even when the printing machine is not in use, thereby minimizing any difference in the temperature of the film of ink over the roller length.

U.S. Pat. No. 2,555,410 attempts a different method for maintaining uniform temperature. In this case, the temperature-control medium flows radially from a distributor tube disposed on the inking roller center line into a developing counter-current. The temperature-control medium flows irregularly from bores which are distributed uniformly over the length of the distributor tube and emerges into the main part of the hollow roller. However, it is still not possible to achieve a constant temperature over the roller length, even with this method.

OBJECTS AND SUMMARY OF THE INVENTION

The primary aim of the present invention is to maintain a uniform temperature distribution over the entire surface of the inking roller, and allow rapid control in order to achieve and maintain the required operating temperature with optimum thermal conductivity.

To achieve this end, the inking roller is made from a ribbed aluminum barrel having roller journals mounted at both ends. The roller cross-section is formed with a plurality of passages or ducts disposed in the barrel wall. The ducts are interconnected in pairs via a recess on the opposite internal end face of the journal from where the temperature-control medium is supplied and discharged, and the connection is such that the supply and return are disposed alternately side by side.

Consisting of just one part, the ribbed barrel is very easily made as a continuous casting or extrusion. The aluminum material has a much more favorable thermal conductivity than other conventional materials for inking rollers and much better corrosion characteristics. The life of the inking roller is thus considerably increased. The weight reduction of the inking roller is another advantage, since in large printing machines the inking rollers of conventional construction are very heavy.

The above-mentioned thermal conductivity enables operating temperatures to be achieved quickly, minimizing the heating-up stage. The thermal conductivity also has a positive effect on maintaining a given operating temperature, since the control responds with optimum speed.

The uniform temperature distribution at the surface of the inking roller results in printed text which is consistent over its entire width. The ducts cover the lateral zones of the inking roller so that printed text is uniform at the edge zones as well. The ducts are situated in one plane in the barrel wall, and thus are the same distance from the inking roller surface; this additionally contributes to uniform temperature control.

In the preferred embodiment there are a plurality of ducts disposed in the barrel wall. Due to the axial ribbing between the ducts and the hollow central part, the inking roller has considerable flexural stiffness. This special configuration is selected in order to keep manufacturing costs very low, since this form can very easily be produced by extrusion or the continuous casting method.

Pursuant to the invention, the ducts are interconnected in pairs via recesses on the opposite side to that where the temperature-control medium is supplied and discharged, the connections being such that the supply and return are disposed alternately side by side. Since a temperature-control medium return duct is disposed between each pair of supply ducts, the inking roller temperature reaches an optimum uniform value over its entire surface.

Assembly is also facilitated by cylindrical openings at the end faces of the barrel, into which the internal ends of roller journals are fitted and secured. Because of its simple configuration the inking roller is much more economical to manufacture than the known inking rollers in which the shape renders a considerable number of weld seams essential. On assembly of the present invention, the roller journals simply are fitted and bolted at both ends of the barrel. Additionally, the roller journals can be easily unbolted and the barrel can thus be readily removed if repairs are required.

At least one ring seal is preferably disposed in the internal locating surface between the roller mountings and the barrel. In this way the inking roller is sealed by a simple means as a result of the special locating surface and the ring seal.

In further accordance with the invention, the supply and return ducts for the temperature-control medium are the same size and are kidney-shaped. The size of the kidney shape is so selected that the temperature-control medium flowing therethrough undergoes optimum mixing because of the speed of rotation of the inking roller. This results in a very favorable heat transfer between the temperature-control medium and the adjoining duct walls. The configuration of the ducts reduces the effective flow cross-section in comparison with conventional known constructions. As a result, the flow speed of the temperature-control medium, in both the supply and the return directions, is increased.

The supply and return ducts in the barrel wall are very easily connected to the temperature-control medium supply and discharge by means of star-shaped bores extending radially from the center-line inside one of the roller mountings. These star-shaped supply and discharge means are situated in two planes inside the roller journal. It will be understood, of course, that the number of supply and discharge ducts can vary according to the size and construction of the roller.

These and other advantages and features of the invention will be more readily apparent upon reading the following description in conjunction with a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
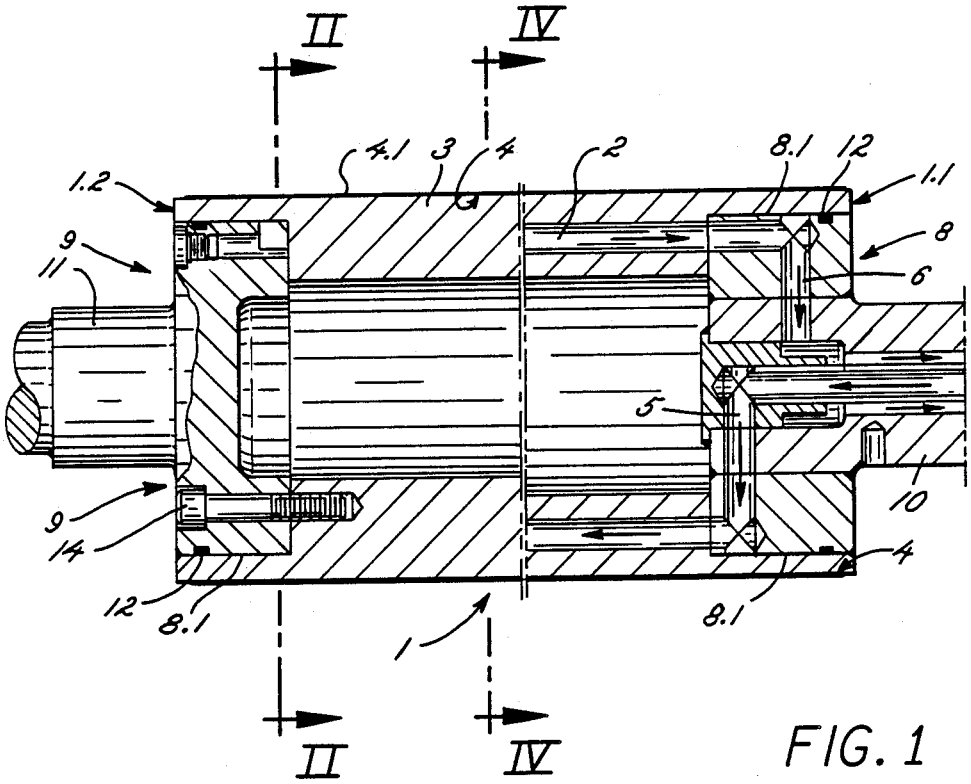
FIG. 1 is a longitudinal section through the inking roller of the invention, where the left and right halves are taken substantially along lines $I_1$–$I_1$ and $I_2$–$I_2$ respectively in FIG. 2.

Turning now to the drawings, FIG. 1 shows an inking roller 1 of a printing machine which is not otherwise shown in detail. The inking roller 1 is comprised of an aluminum barrel 3 and roller journals 10, 11. The roller journals 10, 11 fit into cylindrical openings 8, 9 in the end faces 1.1, 1.2 of the roller barrel 3, and are secured to the barrel 3 by means of bolts 14. An annular seal 12 is provided between an internal cylindrical locating surface 8.1 at each end of the barrel 3 and the cylindrical inner end of the roller journals 10, 11. Preferably, the outer surface 4 of barrel 3 has a covering 4.1.

Figure 2:
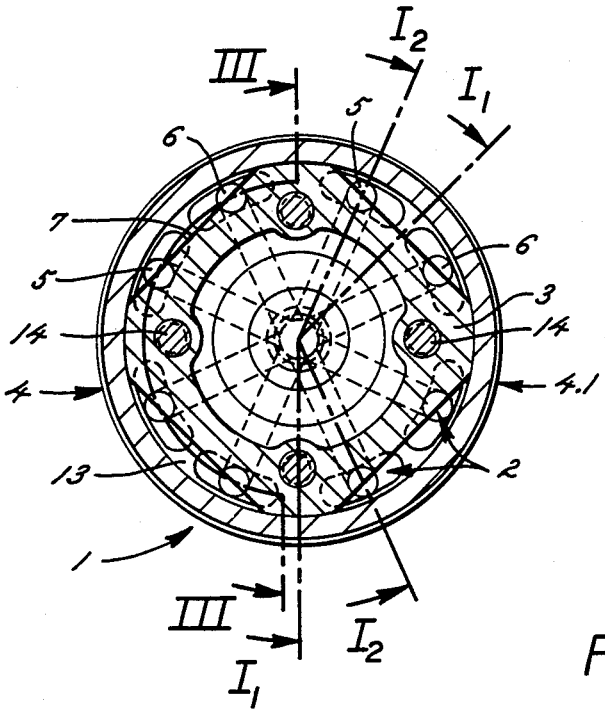
FIG. 2 is a cross-section through the inking roller shown in FIG. 1 taken substantially along line II—II.

In accordance with the invention, the barrel 3 has parallel longitudinal ducts 2 through which a temperature-control medium flows. As shown in FIG. 2, the ducts 2 are kidney shaped and are disposed equally distant from the surface 4 of the barrel 3. The temperature-control medium is supplied to the ducts 2 by supply ports 5 and discharged from the ducts 2 by return ports 6 in the roller journal 10. The ducts 2 are disposed in pairs, alternating between ducts 2 which are supplied by the supply port 5 and ducts which discharge to the return ports 6. The uniform radial position of the ducts 2 and the alternating flow between the supply and return ports 5, 6, results in a substantially uniform temperature at the surface 4 of the roller 1. The temperature-control medium supply and return ports 5, 6 are connected to the ducts by means of star-shaped bores situated in two planes and extending radially inside the roller journal 10.

Figure 3:
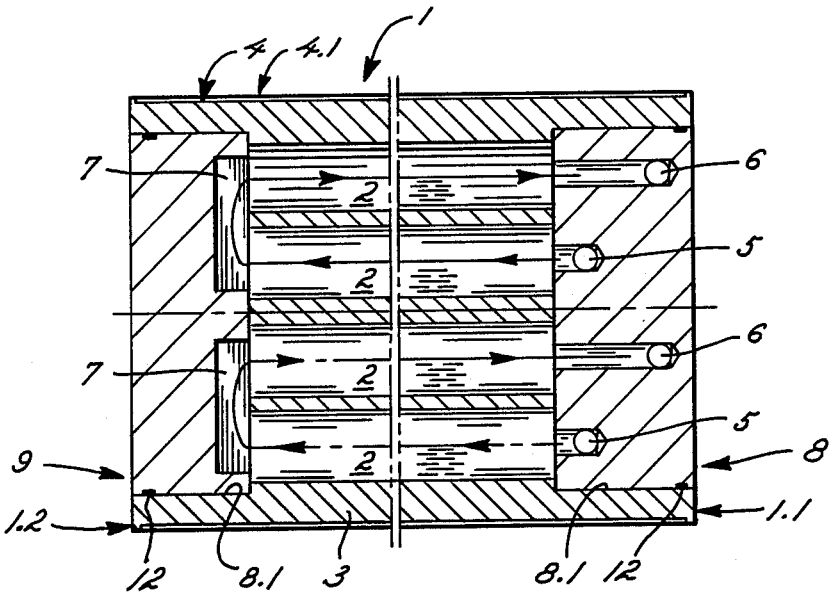
FIG. 3 is a partial longitudinal section of the inking roller as seen substantially along line III—III in FIG. 2 with portions of both ends and the center of the roller removed.
Figure 4:
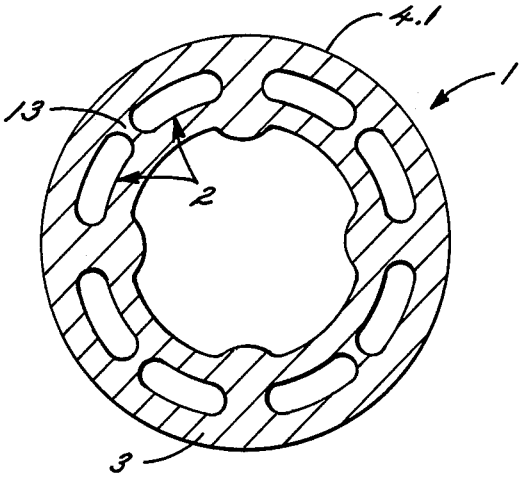
FIG. 4 is cross-section of the inking roller shown in FIG. 1 taken substantially along line IV—IV.

As shown in FIG. 3, the ducts 2 for the alternating supply and return of the temperature-control medium are disposed in adjacent pairs and are connected by recesses 7 formed in the inner face of roller mounting 11. These openings 7 allow continuous flow of the medium within the ducts 2 from supply port 5 to return port 6 in counter-current fashion. In FIG. 4, it will be seen that ribs 13 are formed between the ducts 2 in the wall of the barrel 3. As a result, the hollow barrel 3 has optimum flexural stiffness.

From the foregoing, it will be seen that a light weight yet strong inking roller for printing machines is provided which has good thermal conductivity, and due to the uniform location of the ducts near the roll surface and the counter-current flow path through adjacent ducts, maintains the ink temperature over the entire surface of the roller substantially uniform.

We claim as our invention:

1. An inking roller for an offset printing machine, which is adapted at one end to supply and discharge a temperature-control medium which flows in a counter-current flow and return fashion through free cross sections in the interior of the roller, characterized in that the inking roller is shaped in the form of a barrel and formed of aluminun having radially flanged journals mounted at both ends, the cross-section of the barrel including a plurality of substantially equal sized kidney-shaped ducts disposed near a wall of said barrel, said ducts being connected to the temperature-control medium supply and discharge by alternating star-shaped bores extending radially outwardly from adjacent the center-line inside one of said radially flanged journals mounted at one end of said barrel, said ducts being interconnected in pairs via substantially chord-like recesses formed in said radially flanged journal mounted on the opposite end of said barrel to the end where the temperature-control medium is supplied and discharged, and the connection being such that the flow and return are disposed alternately side by side.

2. An inking roller according to claim 1, characterized in that the barrel is formed with stepped cylindrical end openings in which said radially flanged journals are fitted and secured by suitable fastening means.

3. As inking roller according to claim 2, characterized in that at least one ring seal is disposed in the cylindrical openings between said radially flanged journals and the barrel.

4. An inking roller according to claim 1, characterized in that web-like ribs are provided in the barrel between the ducts and said ribs serve to stiffen the barrel.

5. An inking roller according to claim 2, characterized in that said fastening means includes a plurality of bolts distributed uniformly about the periphery of each of the journals.

* * * * *